US005205403A

United States Patent [19]

DeBlasio

[11] Patent Number: 5,205,403

[45] Date of Patent: Apr. 27, 1993

[54] MULTIPLE UNIT CARTON

[75] Inventor: James A. DeBlasio, Midlothian, Va.

[73] Assignee: Philip Morris Incorporated, New York, N.Y.

[21] Appl. No.: 836,836

[22] Filed: Feb. 19, 1992

Related U.S. Application Data

[63] Continuation-in-part of Ser. No. 774,529, Oct. 8, 1991, Pat. No. 5,141,106.

[51] Int. Cl.[5] ..... B65D 85/10; B65D 5/54

[52] U.S. Cl. ..... 206/256; 206/813; 206/273; 229/120.011; 53/462; 53/448

[58] Field of Search ..... 53/448, 449, 462, 416, 53/466, 443; 206/813, 273, 271, 256; 229/120.11, 120.09

[56] References Cited

U.S. PATENT DOCUMENTS

| | | | |
|---|---|---|---|
| 2,109,583 | 3/1938 | Bennett | 206/813 |
| 2,565,509 | 8/1951 | Marcin | 206/813 |
| 2,605,897 | 8/1952 | Rundle | 206/264 |
| 2,697,544 | 12/1954 | Morand | 229/120.04 |
| 2,771,234 | 11/1956 | Hultin | 229/15 |
| 2,871,080 | 1/1959 | Shelly | 229/120.01 |
| 2,895,601 | 7/1959 | Krukonis | 206/256 |
| 3,071,244 | 1/1963 | Doran | 206/273 |
| 3,082,929 | 3/1963 | Aquino et al. | 206/256 |
| 3,086,650 | 4/1963 | Chapman et al. | 206/273 |
| 3,092,301 | 6/1963 | Selle | 229/51 |
| 3,113,673 | 12/1963 | Stein | 206/65 |
| 3,135,457 | 6/1964 | Risucci | 229/51 |
| 3,144,190 | 8/1964 | Holt et al. | 229/27 |
| 3,158,312 | 11/1964 | Simkins | 229/51 |
| 3,163,351 | 12/1964 | Borgardt | 206/256 |
| 3,447,733 | 6/1969 | Smith et al. | 206/491 |
| 3,503,568 | 3/1970 | Galley | 242/74 |
| 3,536,246 | 10/1970 | Rosen | 206/256 |
| 3,596,758 | 8/1971 | Phillips, Jr. et al. | 206/256 |
| 3,721,335 | 3/1973 | Grant | 206/256 |
| 3,752,308 | 8/1973 | Begemann | 206/273 |
| 3,759,378 | 9/1973 | Werth | 206/429 |
| 3,809,227 | 5/1974 | Begemann | 206/264 |
| 4,205,776 | 6/1980 | Ruer | 229/120.01 |
| 4,424,658 | 1/1984 | Focke | 53/398 |
| 4,441,611 | 4/1984 | Sommariva | 206/431 |
| 4,485,926 | 12/1984 | Lenzmeier | 206/602 |
| 4,631,900 | 12/1986 | Mattei et al. | 53/448 |
| 4,669,611 | 6/1987 | Flaherty | 206/449 |
| 4,738,359 | 4/1988 | Phillips, Jr. | 206/256 |
| 4,928,817 | 5/1990 | Focke | 206/264 |
| 4,932,534 | 6/1990 | Focke et al. | 206/602 |
| 5,058,363 | 10/1991 | Focke et al. | 53/462 |

FOREIGN PATENT DOCUMENTS 358560 10/1931 United Kingdom .

*Primary Examiner*—William I. Price

*Attorney, Agent, or Firm*—Jeffrey H. Ingerman; Karen G. Horowitz

[57] ABSTRACT

A multiple unit carton composed of a plurality of individual cartons joined by carrier means. Each carton holds at least one pair of cigarette packs aligned with their long walls abutting, and their short walls coplanar. The multiple unit carton is preferably dimensioned to resemble a ten-pack cigarette carton so that the multiple unit carton may be passed through commercially available tax-stamping machinery, which is commonly designed to process ten-pack cigarette cartons. The individual cartons are joined with adhesive bearing carrier means such that the cartons remain securely connected when being passed through tax-stamping machinery.

42 Claims, 3 Drawing Sheets

MULTIPLE UNIT CARTON

CROSS REFERENCE TO RELATED APPLICATION

This application is a continuation-in-part of copending, commonly-assigned United States patent application Ser. No. 07/774,529, filed Oct. 8, 1991, now U.S. Pat. No. 5,141,106, which is hereby incorporated by reference to its entirety.

BACKGROUND OF THE INVENTION

The present invention relates to cigarette cartons, and more particularly to the connection of at least two cigarette cartons to form a multiple unit carton compatible with commercially available tax-stamping machinery.

Cigarette packs (which usually contain twenty cigarettes) are generally rectangular in shape, having front and back long walls connected by two short side walls. Cigarette packs are-typically packaged by the manufacturer in cigarette cartons, and are arranged so that the front long walls of the packs are in the same plane and the back long walls are in a parallel plane spaced from the front long walls, with adjacent side walls abutting one another. The filled cartons are usually temporarily closed and shipped to various distributors. The distributors generally open the cartons to apply the tax stamp that may be required by the jurisdiction in which they operate to the ends of individual cigarette packs while the packs are still inside the cartons. Such procedures are commonly automated, to reduce time, cost, and labor, through the use of specially designed machines for applying tax stamps. Tax-stamping machines have been developed to open the cartons, apply the stamps, and finally seal the cartons for distribution. Such machines are generally commercially available, and are well known in the art. These machines have been developed for ten-pack cartons, i.e., cartons containing two rows of five cigarette packs per row. A typical tax-stamping machine is model FUSON manufactured by Meyercord of 365 East North Avenue, Carol Stream, Ill. 60187.

Although cigarette packs are commonly sold in ten-pack cartons, it has become desirable to sell smaller units of cigarette packs in smaller cartons than ten-pack cartons. However, because ten-pack cartons are the most common configuration, tax-stamping machinery is designed for stamping groups of five cigarette packs arranged side by side and contained in ten-pack cartons, i.e., for stamping five consecutive pairs of cigarette packs. Consequently, cartons containing fewer than five pairs of cigarette packs cannot readily be passed through existent tax-stamping machines without adjusting the machines. Such cartons are therefore typically hand-stamped, which is both costly and time consuming.

SUMMARY OF THE INVENTION

It is therefore an object of this invention to secure cigarette cartons containing fewer than five pairs of cigarette packs together to form a multiple unit carton of dimensions compatible with existing tax-stamping machinery common to distributors, without requiring customized tax-stamping machinery or hand-stamping of the packs.

It is a further object of this invention to provide a means for securing cartons together for passing through tax-stamping machinery, such that the cartons are not sheared apart by the vertical rollers of the tax-stamping machines which roll along the vertical walls of the cartons to transfer the cartons between the various stages of the process, and such that a tax stamp may be properly registered on the packs.

It is still another object of this invention to provide a means for making a clean separation between the individual cartons if desired for sale as individual cartons instead of a multiple unit carton.

These and other objects of the invention are accomplished in accordance with the principles of the invention by providing at least one carrier means bearing adhesive to securely connect at least two cartons to form a final multiple unit carton of dimensions compatible with commercially available tax-stamping machinery. Each carton in the multiple unit carton is dimensioned to contain at least one pair of cigarette packs arranged with long walls abutting one another and side walls coplanar. The carrier means of the invention allows for the separation of the individual cartons, if desired, for individual sale, without leaving unsightly residue which may negatively effect marketability.

BRIEF DESCRIPTION OF THE DRAWINGS

Further features of the invention, its nature, and various advantages will be more apparent from the following detailed description of the preferred embodiments and the accompanying drawings wherein like reference characters represent like elements throughout, and in which.

DETAILED DESCRIPTION OF THE INVENTION

Figure 1:
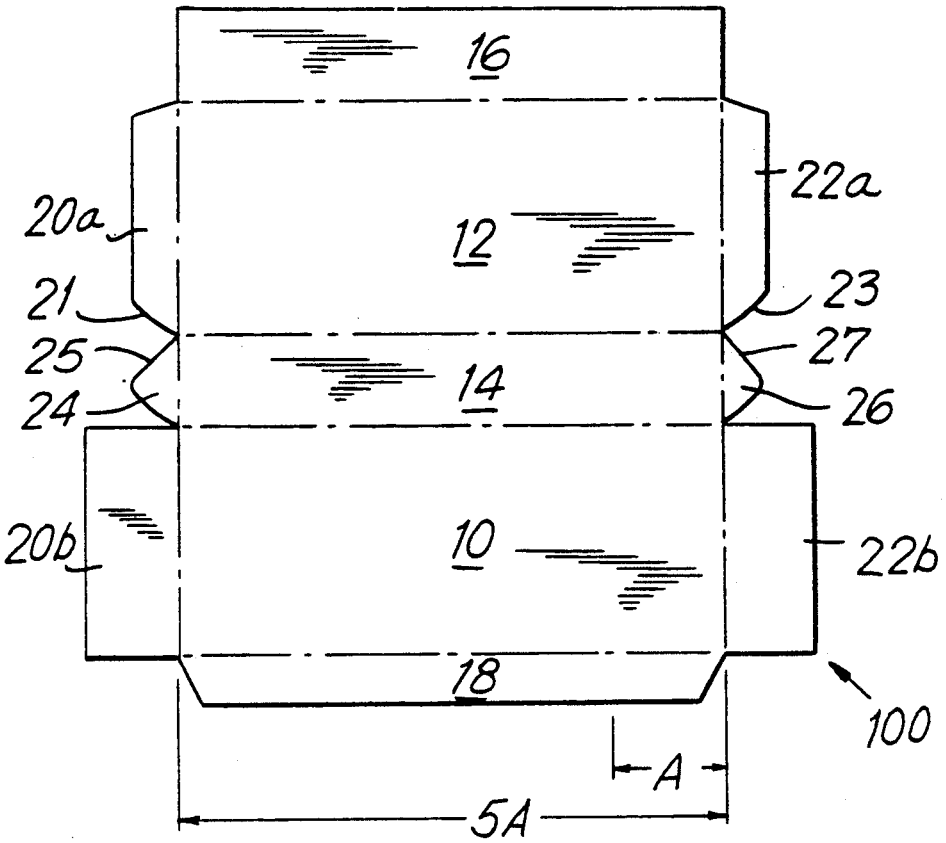
FIG. 1 is a plan view of an illustrative carton blank for a carton in accordance with this invention.

Blank 100, shown in FIG. 1, is an illustrative blank for forming cartons in accordance with this invention. Blank 100 is preferably formed from a substantially stiff material such as cardboard or paperboard, and has a front panel 10, a rear panel 12, and a bottom panel 14, which are each folded along fold lines, shown as broken lines not individually labeled, to form a carton. Outer top extension panel 16, and an inner extension panel 18 are folded over the top of the completed carton, with panel 16 above panel 18, to form a top wall. Preferably panel 16 extends the entire distance between panels 10 and 12 when blank 100 is folded into a carton, while panel 18 preferably extends only half this distance. Dust flaps 24 and 26 are folded preferably perpendicular to bottom wall 14. Panels **20*a* and 22*a* are then folded adjacent dust flaps 24 and 26, respectively, and substantially perpendicular to panel 12. Preferably dust flaps 24 and 26 include cut edges 25 and 27, respectively, and panels 20***a* and 22*a* include cut edges 21 and 23, respectively. When included, edge 21 aligns with edge 25 and edge 23 aligns with edge 27 so that panel 20*a* lies in the same plane as dust flap 24, and panel 22*a* lies in the same plane as dust flap 26. Panels 20*b* and 22*b* are folded over panels 20*a* and 22*a*, respectively, to complete side wall 20, formed by panels 20*a* and 20*b*, and side wall 22, formed by panels 22*a* and 22*b*. Although width 5A of panels 10 and 12 of blank 100 is preferably equal to five times dimension A, the width of the long wall of a cigarette pack to be contained in the carton formed by blank 100, the width of panels 10 and 12 can be any multiple of dimension A. Preferably the dimension of side walls 20 and 22 is twice that of the short side wall of a cigarette pack to be contained in the carton formed by blank 100, but may be any multiple of this dimension, as well.

Figure 2:
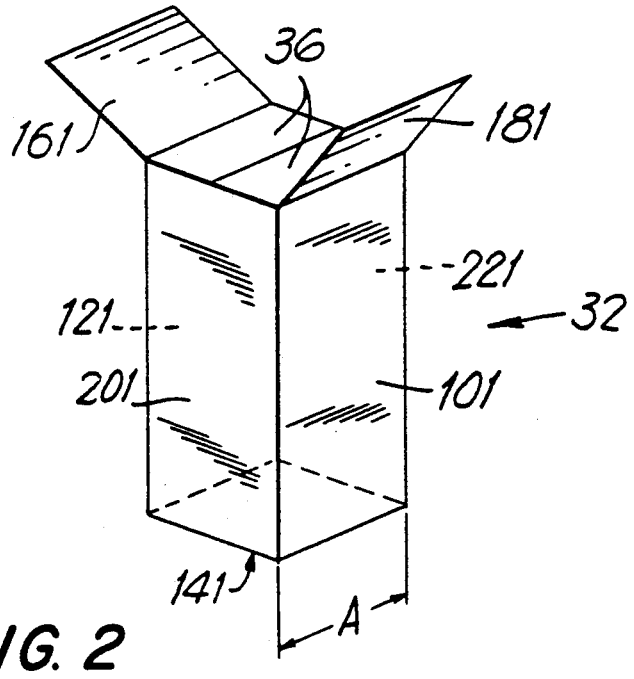
FIG. 2 is an isometric view of a two-pack carton in accordance with this invention.

Two-pack carton 32, formed by a blank similar to blank 100, but with front and rear panels of width A, is shown in FIG. 2. Carton 32 has a front wall 101 from which inner extension panel 181 extends; a rear wall 121 from which outer extension panel 161 extends; side walls 201 and 221; and bottom wall 141. Side walls 201 and 221 are preferably formed of panels similar to panels 20*a*, 20*b*, 22*a*, and 22*b*. Preferably panel 161 is the same dimension as wall 141, extending the entire distance between walls 101 and 121, while panel 181 preferably only extends approximately half this distance. Carton 32 is dimensioned to contain two cigarette packs 36, arranged in carton 32 with their long walls parallel to front wall 101 and rear wall 121, and their side walls parallel to side walls 201 and 221.

Figure 3:
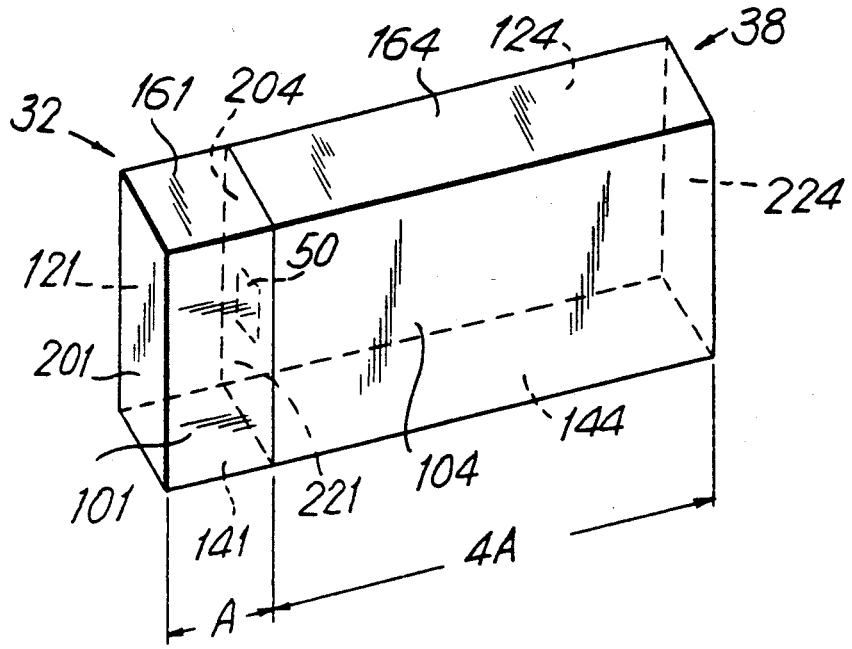
FIG. 3 is an isometric view of a two-pack carton joined to an eight-pack carton in accordance with this invention.

In FIG. 3, two cartons, 32 and 38, are connected along side wall 221 of two-pack carton 32, and side wall 204 of eight-pack carton 38, to form a ten-pack carton. Carton 32 is the same as carton 32 shown in FIG. 2. Carton 38 is similar to carton 32, having a front wall 104, a rear wall 124, a top wall 164 (formed from two extension panels similar to panels 161 and 181), a bottom wall 144, and side walls 204 and 224 (each formed from side panels similar to panels 20*a*, 20*b*, 22*a*, and 22*b*). However, the dimension of panels 104 and 124 of carton 38 is 4A, as opposed to A, the dimension of panels 101 and 121 of carton 32. Carton 38 is thus dimensioned to contain eight cigarette packs arranged in two rows of four packs per row (i.e., four columns of two packs each). As shown, cartons 32 and 38 are joined by a carrier means bearing adhesive, hereinafter referred to as sticker 50, which is described in greater detail below.

Panels 161 and 164 extend from rear walls 121 and 124, respectively, of cartons 32 and 38, and preferably extend the entire distance between walls 101, 121, 104, and 124. Cartons 32 and 38 are shown joined along side wall 221 of carton 32 and side wall 204 of carton 38 such that front walls 101 and 104 are coplanar, and rear walls 121 and 124 are coplanar. Hence, panels 161 and 164 extend from the same side of the combined carton. Panel 181, and the corresponding panel extending from front wall 104 of carton 38, are preferably shorter than panels 161 and 164, such that the top extension panel configurations of cartons 32 and 38 resemble the top extension panel configuration of a typical cigarette carton. In this configuration, the tax-stamping machine through which the multiple unit carton is passed can easily open the top extension panels of the multiple unit carton to apply the required tax stamp to cigarette packs contained within the carton.

Figure 4:
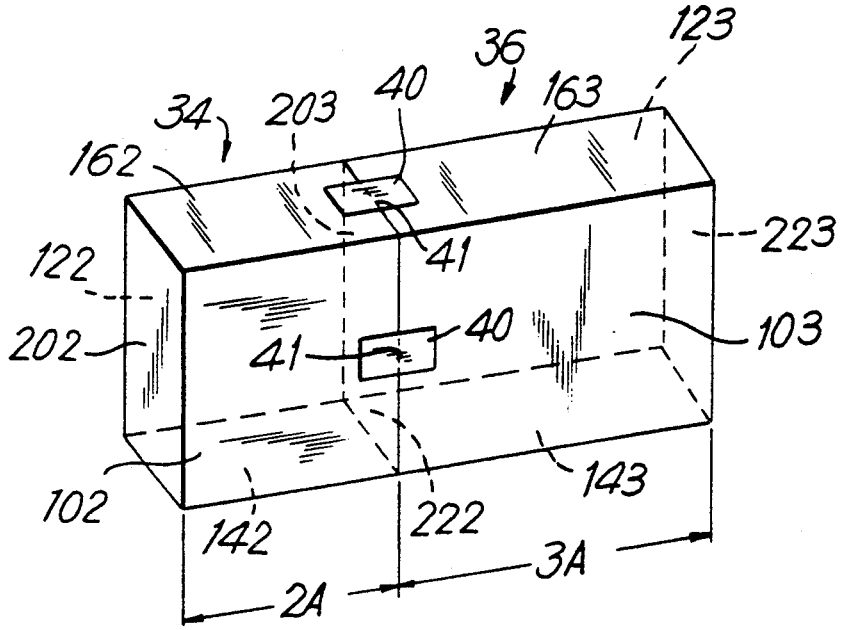
FIG. 4 is an isometric view of a four-pack carton joined to a six-pack carton in accordance with this invention.

A multiple unit carton similar to the carton of FIG. 3 is shown in FIG. 4, made up of a four-pack carton 34 and a six-pack carton 36. Each carton has front walls 102 and 103; rear walls 122 and 123; side walls 202, 222, 203, and 223, formed from side panels similar to panels 20*a*, 20*b*, 22*a*, and 22*b*; bottom walls 142 and 143; and top walls 162 and 163, formed from extension panels similar to panels 16 and 18. Cartons 34 and 36 thus resemble one another, except the dimension of panels 102 and 122 is 2A, twice the width of a long wall of a cigarette pack, while the dimension of panels 103 and 123 is 3A, three times the width of a long wall of a cigarette pack. Carton 34 thus is dimensioned to contain four cigarette packs while carton 36 is dimensioned to contain six cigarette packs, the packs arranged with their long walls parallel the front and rear walls of the cartons and their side walls abutting one another and parallel to the side walls of the cartons.

Cartons 34 and 36 are shown joined by at least one carrier means bearing adhesive, hereinafter referred to as sticker 40, positioned across adjacent coplanar walls. The carrier means of sticker 40 is preferably mylar or paper, and bears either a permanent adhesive (any known permanent adhesive) or a releasable pressure-sensitive adhesive. Releasable, pressure-sensitive adhesive is herein defined as any adhesive known in the art which has no taste or odor, and does not cause fiber pull of the carrier means or leave a tacky residue once the surfaces joined by the adhesive are separated (e.g., any known adhesive which provides a strong bond between surfaces but once the surfaces are pulled apart, the bonds of the adhesive are broken and the adhesive is no longer tacky). The adhesive must be sufficiently strong to hold the cartons firmly in place relative to one another and resist such shearing force which would reasonably be applied through a difference in forces applied by vertical rollers of tax-stamping machines which roll along the front and rear walls of the cartons during the tax-stamping process. The carrier means of sticker 40 preferably includes a line of weakness such as perforated line 41, which is preferably positioned along the plane of abutment of the two cartons to facilitate separation of the two cartons.

Sticker 40 may optionally bear pricing indicia such as Universal Product Code (U.P.C.) or other pricing bar code, such as described in copending, commonly-assigned United States patent application Ser. No. 07/792,617, filed Nov. 15, 1991, which is hereby incorporated by reference in its entirety. A sticker bearing such pricing indicia is preferably placed along and across adjacent coplanar walls with the lines of the pricing bar code positioned substantially parallel to the adjacent edges of the adjacent walls across which the sticker is placed. Preferably, such a sticker also has such a perforated line as line 41, positioned substantially parallel to the edges of the walls across which the sticker is placed, and therefore substantially parallel to the lines of the bar code as well. When the cartons are separated, the pricing indicia are separated along a line substantially parallel to the bar code, and thus are rendered unreadable by automatic scanning equipment, so that a consumer will not be charged the price of the dual carton for purchase of an individual carton.

Figure 5:
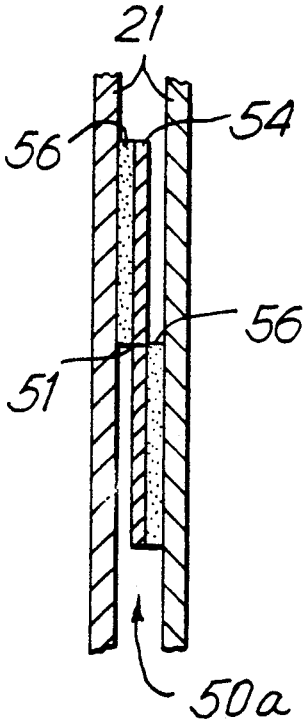
FIG. 5 is an enlarged partial side view in cross section of two cartons connected with an illustrative carrier means bearing adhesive affixed between the cartons and not readily visible.
Figure 6:
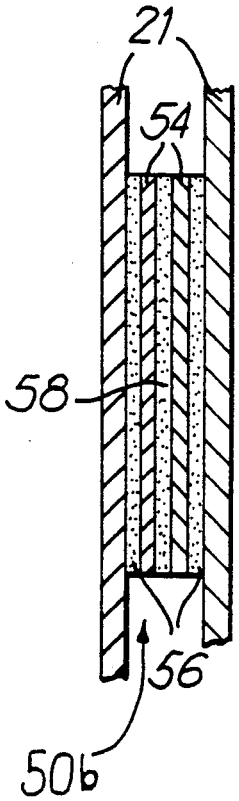
FIG. 6 is an enlarged partial side view in cross section of two cartons connected with two illustrative carrier means bearing adhesive, affixed in a similar fashion as shown in FIG. 5.

Two embodiments of sticker 50 are shown in FIGS. 5 and 6. Sticker 50*a*, of FIG. 5, has a single carrier means 54, such as mylar or paper, with permanent adhesive 56 (any known permanent adhesive) applied to both sides of carrier means 54. Adhesive 56 is preferably only applied to one half of each side of carrier means 54, on opposite ends of carrier means 54, such that along the length of carrier means 54 at each point along the length there is adhesive only on one side of carrier means 54. Hence, when sticker 50*a* is applied between side walls 21 of two cartons to be joined by sticker 50*a*, one half of sticker 50*a* adheres to side wall 21 of one carton and the other half of sticker 50*a* adheres to side wall 21 of the other carton. The halves are preferably separated by tearing carrier means 54 along a line of weakness such as perforated line 51, at the border of each adhesive half, i.e., along a line dividing the halves. Hence, side walls 21 are securely fastened to one another during the tax-stamping process, but later may be separated from one another without much difficulty and without leaving behind any unsightly residue or frayed carrier means edges.

Sticker 50*b*, shown in FIG. 6, is comprised of two carrier means 54, such as mylar or paper, set between side walls 21 of two cartons. The side of each carrier means 54 immediately facing a wall 21 of a carton carries permanent adhesive 56 (any known permanent adhesive). The side of each carrier means 54 immediately facing a carrier means carries releasable, pressure-sensitive adhesive 58. Hence, both carrier means 54 are securely held onto their respective walls 21 by adhesive 56 and are also securely connected to each other by adhesive 58 while undergoing the mechanized tax-stamping process. If separation of the two cartons is desired, carrier means 54 may be pulled apart along tack/non-tack releasable adhesive 58. Adhesive 58 is chosen such that when the cartons are separated, the surface of carrier means 54 leaves no tacky residue.

Although cartons 32 and 38 are shown in FIG. 3 as joined by sticker 50, sticker 40 may be used in combination with sticker 50 or only sticker 40 may be used to join cartons 32 and 38. Likewise, although cartons 34 and 36 are shown in FIG. 4 as joined by sticker 40, sticker 50 may be used in combination with sticker 40 or only sticker 50 may be used to join cartons 34 and 36. Moreover, any desired number of stickers 40 or 50 may be used to join any of the cartons to each other, and either or both embodiments of sticker 50 may be used. Additionally, a transparent band of material such as common in the art, may be wrapped around the cartons to further secure them together.

Although adhesives 56 and 58 are described as being permanent and releasable, respectively, it will be appreciated that adhesive 56 may alternatively be a releasable adhesive and adhesive 58 may alternatively be a permanent adhesive, both adhesives being known in the art.

Although "b" panels 20*b* and 22*b* are dimensioned so that the "b" panels are to be folded over "a" panels 20*a* and 22*a* to form side walls, the "a" panels may be dimensioned to be folded over the "b" panels, instead.

It will be appreciated that sticker 40 may or may not bear U.P.C. indicia, preferably bearing coding for ten-pack sale. If such indicia are included, the sticker bearing indicia may be used in combination with any or all of the disclosed stickers. Such indicia are situated such that the coding for ten-pack sale is rendered unreadable by machinery designed to automatically read U.P.C. labels upon separation of the cartons. Additional U.P.C. labels are preferably provided on walls 21 which are not visible when the cartons are connected but become visible upon separation of the cartons and destruction of the sticker bearing coding for ten-pack sale. Furthermore, such indicia may be located on a sticker placed across any pair of adjacent coplanar walls as desired. Preferably, only one sticker bearing pricing indicia is visible when the cartons are joined in multiple carton configuration.

Although only the connections of a two-pack carton with an eight-pack carton and a four-pack carton with a six-pack carton are shown, any other combinations of cigarette cartons is within the scope of this invention. Thus, for example, five two-pack cartons may be joined to form a multiple unit ten-pack carton. Moreover, the dimension of the multiple unit carton formed by the connection of cartons is not limited to that of a ten-pack carton, but may be of any desired dimension for containing any convenient number of cigarette packs.

It will be appreciated that references to cigarette cartons and cigarette packs are not limited to only rectangular cartons and packs, but are intended to include all configurations which are available to consumers. Cigarette cartons include cartons with windows, cartons with rounded edges, and other configurations which are designed to be passed through tax-stamping equipment. Cigarette packs include such packs as oval packs, packs with rounded edges, and other non-rectangular shapes.

It will be appreciated that references to tax-stamping machinery are intended to include any existing equipment which is readily available to distributors, and modified versions.

It will be appreciated that the directional references "top", "bottom", "front", and "rear" do not limit the respective panels to such orientation, but merely serve to distinguish these panels from one another.

It will be understood that the foregoing is merely illustrative of the principles of the invention, and that various modification can be made by those skilled in the art without departing from the scope and spirit of the invention. For example, such connection of cartons may be applied to any cartons, and is not limited to cigarette cartons. The described embodiments are presented for the purpose of illustration rather than limitation, and the present invention is limited only by the claims which follow.

What is claimed is:

1. A multiple unit cigarette carton for packaging cigarette packs and of dimensions compatible with commercially available tax-stamping machinery used in the automated processing of cigarette cartons, each said cigarette pack having a pair of opposed long walls and a pair of opposed short walls, said multiple-unit cigarette carton comprising:

a first carton having a first pair of first and second opposed walls, each wall at least as wide as a first number of times the width of the long wall of a cigarette pack; and a second pair of third and fourth opposed walls, each wall at least as wide as a second number of times the width of the short wall of a cigarette pack;

a second carton having a third pair of fifth and sixth opposed walls, each wall at least as wide as a third number of times the width of the long wall of a cigarette pack; and a fourth pair of seventh and eighth opposed walls, each wall being substantially the same width as said third and fourth walls of said first carton; wherein:

said first and second cartons are positioned with one of said third and fourth walls of said first carton adjacent and coextensive with one of said seventh and eighth walls of said second carton to form said multiple unit carton composed of at least said first and second carton joined along adjacent coextensive walls; said multiple unit carton further comprising:

at least one substantially flat carrier means having a first side and a second side, and an adhesive borne on at least part of at least one side of said carrier means, said carrier means bearing said adhesive being positioned across at least two adjacent walls of said first and second cartons with said adhesive in operative contact with said at least two adjacent walls to securely yet releasably connect said cartons in position adjacent one another.

2. The multiple unit carton of claim 1 wherein:

one half of said carrier means bears adhesive only on said first side and the remaining half of said carrier means bears adhesive only on said second side;

said carrier means is positioned between said adjacent coextensive walls of said first and second cartons; and said adhesive bearing half of said first side of said carrier means is in operative contact with said first carton and said adhesive bearing half of said second side of said carrier means is in operative contact with said second carton.

3. The multiple unit carton of claim 2 wherein said carrier means has a line of weakness along a line dividing said half with adhesive only on said first side from said half with adhesive only on said second side.

4. The multiple unit carton of claim 3 wherein said line of weakness is constituted by a line of perforations.

5. The multiple unit carton of claim 2 wherein said adhesive is a permanent adhesive.

6. The multiple unit carton of claim 2 wherein said adhesive is a releasable adhesive.

7. The multiple unit carton of claim 6 wherein said adhesive is a pressure-sensitive adhesive.

8. The multiple unit carton of claim 1 wherein said at least one carrier means includes a first carrier means whose first side is directly adhered to said one of said third and fourth walls of said first carton, and a second carrier means whose second side is directly adhered to said one of said seventh and eighth walls of said second carton, and said second side of said first carrier means is releasably connected to said first side of said second carrier means.

9. The multiple unit carton of claim 8 wherein:

said first side of said first carrier means and said second side of said second carrier means bear permanent adhesive for attachment to said first and second cartons, respectively; and said second side of said first carrier means and said first side of said second carrier means bear releasable, pressure-sensitive adhesive for attachment of said first and second carrier means to each other.

10. The multiple unit carton of claim 9 wherein said releasable adhesive leaves a surface free of tacky residue upon separation of said first and second cartons.

11. The multiple unit carton of claim 1 wherein:

only one of said first and second sides of said carrier means bears adhesive; and the side of said carrier means which bears adhesive is positioned across at least two adjacent coplanar walls of said first and second cartons with said adhesive bearing side in operative contact with said adjacent coplanar walls.

12. The multiple unit carton of claim 11 wherein said carrier means has a line of weakness positioned above and substantially parallel to the adjacent edges of the adjacent coplanar walls across which said carrier means is positioned.

13. The multiple unit carton of claim 12 wherein said line of weakness is constituted by a line of perforations.

14. The multiple unit carton of claim 11 wherein said adhesive is a permanent adhesive.

15. The multiple unit carton of claim 11 wherein said adhesive is a releasable adhesive.

16. The multiple unit carton of claim 15 wherein said adhesive is a pressure-sensitive adhesive.

17. The multiple unit carton of claim 11 wherein said carrier means bears indicia coded for the pricing of the multiple unit carton.

18. The multiple unit carton of claim 17 wherein said carrier means is positioned such that said indicia are rendered unreadable by automatic scanning equipment when said carrier means is severed to separate said first and second cartons.

19. The multiple unit carton of claim 11 wherein said first and second cartons each further include a top wall and a bottom wall.

20. The multiple unit carton of claim 19 wherein said carrier means is positioned across said top walls of said first and second cartons.

21. The multiple unit carton of claim 19 wherein said carrier means is positioned across said bottom walls of said first and second cartons.

22. The multiple unit carton of claim 1 wherein said second number of times the width of the short wall of a cigarette pack is twice the width of the short wall of a cigarette pack.

23. The multiple unit carton of claim 22 wherein the sum of said first and third number of times the width of the long wall of a cigarette pack is equal to five.

24. The multiple unit carton of claim 1 further including at least one additional carton having a pair of first and second primary walls and a pair of first and second secondary walls, each said secondary wall being substantially the same width as said third and fourth walls of said first carton; wherein:

said at least one additional carton is positioned with one of said secondary walls adjacent and coextensive with one of said walls of a carton of said multiple unit carton which is at least as wide as a second number of times the width of the short wall of a cigarette pack; and said pair of primary walls is parallel to and aligned with said first pair of walls of said first carton and said third pair of walls of said second carton such that said multiple unit carton is dimensioned to contain a fourth number of cigarette packs aligned with said long walls of said cigarette packs parallel to said last-mentioned aligned walls of said cartons of said multiple unit carton; said multiple unit carton further comprising:

at least one additional substantially flat carrier means having a first side and a second side, and an adhesive borne on at least part of at least one side of said carrier means, said carrier means bearing said adhesive being positioned across at least two adjacent walls of said additional carton and said carton to which said at least one additional carton is joined with said adhesive in operative contact with said at least two adjacent walls to securely yet releasably connect said joined cartons in position adjacent one another.

25. The multiple unit carton of claim 24 wherein said second number of times the width of the short wall of a cigarette pack is two times the width of the short wall of a cigarette pack to be contained within said multiple unit carton such that each carton is dimensioned to contain at least one pair of cigarette packs arranged with their short walls parallel to said walls which are at least as wide as a second number of times the width of the short wall of a cigarette pack.

26. The multiple unit carton of claim 24 wherein the width of said primary walls of said at least one additional carton is at least as wide as a multiple of the width of the long wall of a cigarette pack.

27. The multiple unit carton of claim 24 wherein the number of cartons joined to each other is such that said multiple unit carton is dimensioned to contain five columns of cigarette packs, each column having two cigarette packs per column, wherein:

said columns are arranged with the short walls of the packs in one column abutting the adjacent short walls of the packs in the adjacent column; and each of said cartons of said multiple unit carton contains at least one column of cigarette packs.

28. The multiple unit carton of claim 1 wherein:

said first carton further includes a first extension panel extending from a first edge of said first wall and having a free edge, and a second extension panel extending from a first edge of said second wall juxtaposed to said first extension panel and having a free edge;

said free edge of said first extension panel lies adjacent said first edge of said second wall when said first extension panel is folded substantially perpendicular to said first wall and toward said second wall;

said second carton further includes a third extension panel extending from a first edge of said fifth wall and having a free edge, and a fourth extension panel extending from a first edge of said sixth wall juxtaposed to said third extension panel and having a free edge;

said free edge of said third extension panel lies adjacent said first edge of said sixth wall when said first extension panel is folded substantially perpendicular to said fifth wall and toward said sixth wall; and said first and second cartons are positioned adjacent one another such that said first extension panel is adjacent said third extension panel and said second extension panel is adjacent said fourth extension panel.

29. The multiple unit carton of claim 28 wherein:

said free edge of said second extension panel lies between said first and second walls when said second extension panel is folded substantially perpendicular to said second wall and toward said first wall; and said free edge of said fourth extension panel lies between said fifth and sixth walls when said fourth extension panel is folded substantially perpendicular to said sixth wall and toward said fifth wall.

30. A method for packaging cigarette packs which are to be passed through tax-stamping machinery used in the automated processing of cigarette cartons and later may be separated into groups of cigarette packs, each said cigarette pack having a pair of opposed long walls and a pair of opposed short walls, said method comprising the steps of:

providing a first carton having a first pair of first and second opposed walls each wall at least as wide as a first number of times the width of the long wall of a cigarette pack; and a second pair of third and fourth opposed walls, each wall at least as wide as a second number of times the width of the short wall of a cigarette pack;

providing a second carton having a third pair of fifth and sixth opposed walls, each wall at least as wide as a third number of times the width of the long wall of a cigarette pack; and a fourth pair of seventh and eighth opposed walls, each wall being substantially the same width as said third and fourth walls of said first carton;

positioning said first and second cartons adjacent one another with one of said third and fourth walls of said first carton adjacent and coextensive with one of said seventh and eighth walls of said second carton; and releasably attaching said first and second cartons together, including the step of positioning at least one substantially flat carrier means having a first side and a second side and an adhesive borne on at least part of at least one side of said carrier means across at least two adjacent walls of said first and second cartons with said adhesive in operative contact with said adjacent walls to securely yet releasably connect said cartons in position adjacent one another in a multiple unit configuration so that said cartons will maintain their relative positions in a subsequent passage through a tax-stamping machine.

31. The method of claim 30 further including the steps of:

passing said multiple unit carton through a tax-stamping machine;

transporting said multiple unit carton to a place for retail sale; and separating said multiple unit carton into separate cartons by a step including severing said at least one carrier means.

32. The method of claim 30 further including the step of providing a number of cartons such that the sum of the widths of said first wall of said first carton, said fifth wall of said second carton, and the walls of any additional cartons adjacent said first and fifth walls is equal to five times the width of the long wall of a cigarette pack to be contained within said cartons.

33. The method of claim 32 wherein each said carton holds at least one pair of cigarette packs arranged with their side walls parallel the walls along which said cartons are connected to form said multiple unit carton such that said step of providing a number of cartons includes the step of providing sufficient cartons for the dimension of said multiple unit carton to be substantially the same as that of a carton dimensioned to hold two rows of five cigarette packs per row, said packs arranged with their short walls abutting one another in said rows.

34. The method of claim 30 wherein said step of positioning at least one carrier means bearing adhesive further includes the step of positioning at least one carrier means bearing adhesive on said first side across adjacent coplanar walls of said first and second cartons with said adhesive-bearing side in operative contact with said adjacent coplanar walls.

35. The method of claim 34 further including the steps of:

providing said at least one carrier means with a line of weakness; and positioning said line of weakness substantially parallel to the adjacent edges of said adjacent coplanar walls of said first and second cartons.

36. The method of claim 30 wherein one half of said at least one carrier means bears adhesive only on said first side and the other half of said at least one carrier means bears adhesive only on said second side; and said step of positioning at least one carrier means includes the step of positioning said at least one carrier means between adjacent walls of said cartons such that said at least one carrier means is not readily visible when said first and second cartons are joined.

37. The method of claim 36 further including the step of providing said carrier means with a line of weakness along a line dividing said half with adhesive only on said first side and said half with adhesive only on said second side.

38. The method of claim 3 wherein said step of positioning at least one carrier means includes the steps of:

directly adhering the first side of a first carrier means to one of said third and fourth walls of said first carton;

directly adhering the second side of a second carrier means to one of said seventh and eighth walls of said second carton;

releasably connecting the second side of said first carrier means to the first side of said second carrier means.

39. A method for packaging cigarette packs which are to be passed through tax-stamping machinery used in the automated processing of cigarete cartons and later may be separated into groups of cigarette packs, each said cigarette pack having a pair of opposed long walls and a pair of opposed short walls, said method comprising the steps of:

providing a plurality of cigarette cartons each having a first pair of substantially vertical opposed walls and a second pair of substantially vertical opposed walls, wherein each said carton is dimensioned to contain a predetermined number of cigarette packs arranged with the short walls of said packs parallel to said second pair of walls; and joining said plurality of cigarette cartons with a carrier means bearing adhesive such that the respective second pairs of walls of each said carton are in parallel spaced apart planes.

40. The method of claim 39 further including the step of joining a sufficient number of said cigarette cartons such that the multiple unit carton formed by said joined cartons is of substantially the same dimensions as a carton dimensioned to contain two rows of five cigarette packs per row, said packs arranged in each row with their short walls abutting one another and in parallel spaced apart planes.

41. The method of claim 40 further including the steps of:

passing said multiple unit carton through a tax-stamping machine;

transporting said multiple unit carton to a place for retail sale; and separating said multiple unit carton into separate cartons.

42. The method of claim 41 wherein said carrier means has a first side and a second side and bears adhesive on at least half of at least one of said first and second sides, and said step of joining said cartons includes the step of positioning said carrier means across a pair of adjacent walls of said cartons.

* * * * *